US006029878A

United States Patent [19]

Pfister et al.

[11] Patent Number: 6,029,878

[45] Date of Patent: Feb. 29, 2000

[54] SETTING TOOL

[75] Inventors: Norbert Pfister, Montlingen; Norbert Heeb, Buchs; Sybille Renner, Grabs, all of Switzerland; Norbert Welte, Klaus, Austria

[73] Assignee: Hilti Aktiengesellschaft, Schaan, Liechtenstein

[21] Appl. No.: 09/186,508

[22] Filed: Nov. 4, 1998

[30] Foreign Application Priority Data

Nov. 6, 1997 [DE] Germany ..... 197 49 027

[51] Int. Cl.[7] ..... B25C 1/14

[52] U.S. Cl. ..... 227/10

[58] Field of Search ..... 227/9, 10, 11, 227/130

[56] References Cited

U.S. PATENT DOCUMENTS 3,565,313 2/1971 Seghezzi et al. ..... 227/10

3,820,703 6/1974 Rangger ..... 227/10

4,374,567 2/1983 Combette et al. ..... 227/9

4,405,072 9/1983 Kindle et al. ..... 227/10

5,048,740 9/1991 Beton ..... 227/10

*Primary Examiner*—Scott A. Smith

*Attorney, Agent, or Firm*—Brown & Wood, LLP

[57] ABSTRACT

A setting tool for driving nail-shaped attachment elements into a hard structural component, including a housing (1), a guide cylinder (8) located in the housing (1), a drive piston (7) axially displaceable in the guide cylinder (8) and having a driving surface (74), a spring-biased lever-shaped resetting member (1) pivotable in a plane extending parallel to a setting direction and engageable with the driving surface (74), and a device for displacing the resetting member (1) out of a plane of axial projection of the driving surface (74) into a release position of the resetting member.

8 Claims, 6 Drawing Sheets

SETTING TOOL

BACKGROUND OF THE INVENTION

1. Field of the Invention

The present invention relates to a setting tool for driving nail-shaped attachment elements into a hard structural component, and including a housing, a guide cylinder located in the housing, a drive piston axially displaceable in the guide cylinder and having a driving surface, a lever-shaped resetting member pivotable in a plane extending parallel to a setting direction, an axle for supporting the resetting member for pivotal movement, and a spring for biasing the resetting member toward the driving surface of the drive piston.

2. Description of the Prior Art

At present, explosive powder charge-operated setting tools are used for driving nail-shaped attachment elements into hard structural components, e.g., concrete, rock or steel. These setting tools have a housing, a guide cylinder at least partially located in the housing, a drive piston axially displaceable in the guide cylinder and acting directly on the attachment element during the drive-in process. After each drive-in step, the drive piston should be return into its initial position.

German Publication DE-OS 18 12 207 discloses a setting tool in which the drive piston is returned into its initial position with a lever-shaped, spring-biased resetting member pivotable relative to the setting tool housing in a plane extending in a setting direction. The resetting member projects through a side opening formed in the guide cylinder into the interior of the guide cylinder and cooperates there with the driving surface of the drive piston. The resetting member pivots about a rotational axle supported in the setting tool housing. The biasing spring is supported, on one hand, against the housing and, on the other hand, against the resetting member. The biasing spring becomes preloaded upon displacement of the drive piston in the setting direction. After the completion of a setting process, the spring is relaxed, providing for pivoting of the resetting member in a direction opposite to the setting direction until the drive piston is returned to its initial position.

The drive piston of the above-discussed German Publication has adjacent guide and seal regions, with the guide region facing in the setting direction. The diameter of the seal region substantially corresponds to the diameter of the guide cylinder, and the diameter of the guide region substantially corresponds to the diameter of a guide bore formed in the housing of the setting tool. The guide region of the drive piston is subject to wear, so that the drive piston should be replaced from time to time. In the disclosed setting tool, the replacement of the drive piston is an extremely difficult and time-consuming process. This is because the resetting member, which entirely projects into the guide cylinder, should be dismounted from the housing in order to be able to unscrew the guide cylinder which is connected with the housing by a thread connection.

Accordingly, an object of the present invention is a setting tool which would insure a rapid and simple replacement of the drive piston.

SUMMARY OF THE INVENTION

This and other objects of the present invention, which will become apparent hereinafter, are achieved by providing means for displacing the resetting member out of the plane of an axial projection of the driving surface of the drive piston into a release position of the resetting member. Providing such displacing means enables removal of the drive piston, which is located in the guide cylinder, in the setting direction, without a need to dismantle the entire resetting member.

The simplification of the construction of the setting tool according to the present invention is achieved by mounting the rotational axle of the resetting member advantageously on the guide cylinder. In the setting tool according to the present invention, the resetting member is pressed against the driving surface of the drive piston and, thus, at least partially projects into the guide cylinder. The biasing spring can be formed, e.g., as a torsion spring. Because a portion of the resetting member, which projects out of the guide cylinder, is not manually accessible, there is provided a slide member engageable with the resetting member and displaceable parallel to the setting direction.

The, e.g., sleeve-shaped slide member can be at least partially withdrawn from the guide cylinder in the setting direction when, e.g., the end plate of the housing facing in the setting direction is removed.

The slide member can also be formed, e.g., as a catch member displaceable in the setting direction.

In order to be able to achieve an automatic displacement of the resetting member in its release position after the removal of the end plate from the housing advantageously, e.g., a spring such as a compression spring is provided for the displacement of the slide member. The slide member displacing spring is supported, respectively, against an end face of the slide member facing in a direction opposite to the setting direction, and against a stop edge of the guide cylinder facing in the setting direction. The compression spring should have an adequate spring force for displacing the spring-biased resetting member in its release position.

According to a further development of the present invention, the rotational axle of the resetting member is supported on a carrier arm displaceable relative to the guide cylinder. Upon displacement of the carrier arm, the resetting member supported thereon is displaced from the plane of the axial projection of the driving surface of the drive piston. At that, the resetting member should not be displaced relative to the carrier arm. The resetting member biasing spring is also mounted on the carrier arm.

The carrier arm is preferably displaced in a plane extending parallel to the setting direction. Thus, e.g., the carrier arm is displaceable in the same plane as the resetting member. The carrier arm pivots about a rotary shaft extending transverse to the setting direction and is supported on a carrier member which is connected with the guide cylinder.

The displacement of the carrier arm can also be effected by displacing it transverse to the setting direction. The resetting member, which is supported on the carrier arm, is displaced, in this case, from the plane of the axial projection of the driving surface of the drive piston likewise transverse to the setting direction.

To prevent damage of the setting tool elements, at least one damping member is provided for limiting the pivotal movement of the resetting member. Thereby, a limitation of the resetting member pivotal movement in a direction toward its operational position and/or release position is achieved. As a damping element, springs, elastomeric elements, hydraulic, pneumatic and mechanical systems can be used.

From the point of view of facilitaing the assembly of the tool, the damping element is, advantageously arranged on the carrier arm.

BRIEF DESCRIPTION OF THE DRAWINGS

The features and objects of the present invention will become more apparent, and the invention itself will be best understood from the following detailed description for the preferred embodiments when read with reference to the accompanying drawings, wherein.

DETAILED DESCRIPTION OF THE PREFERRED EMBODIMENTS

Figure 1:
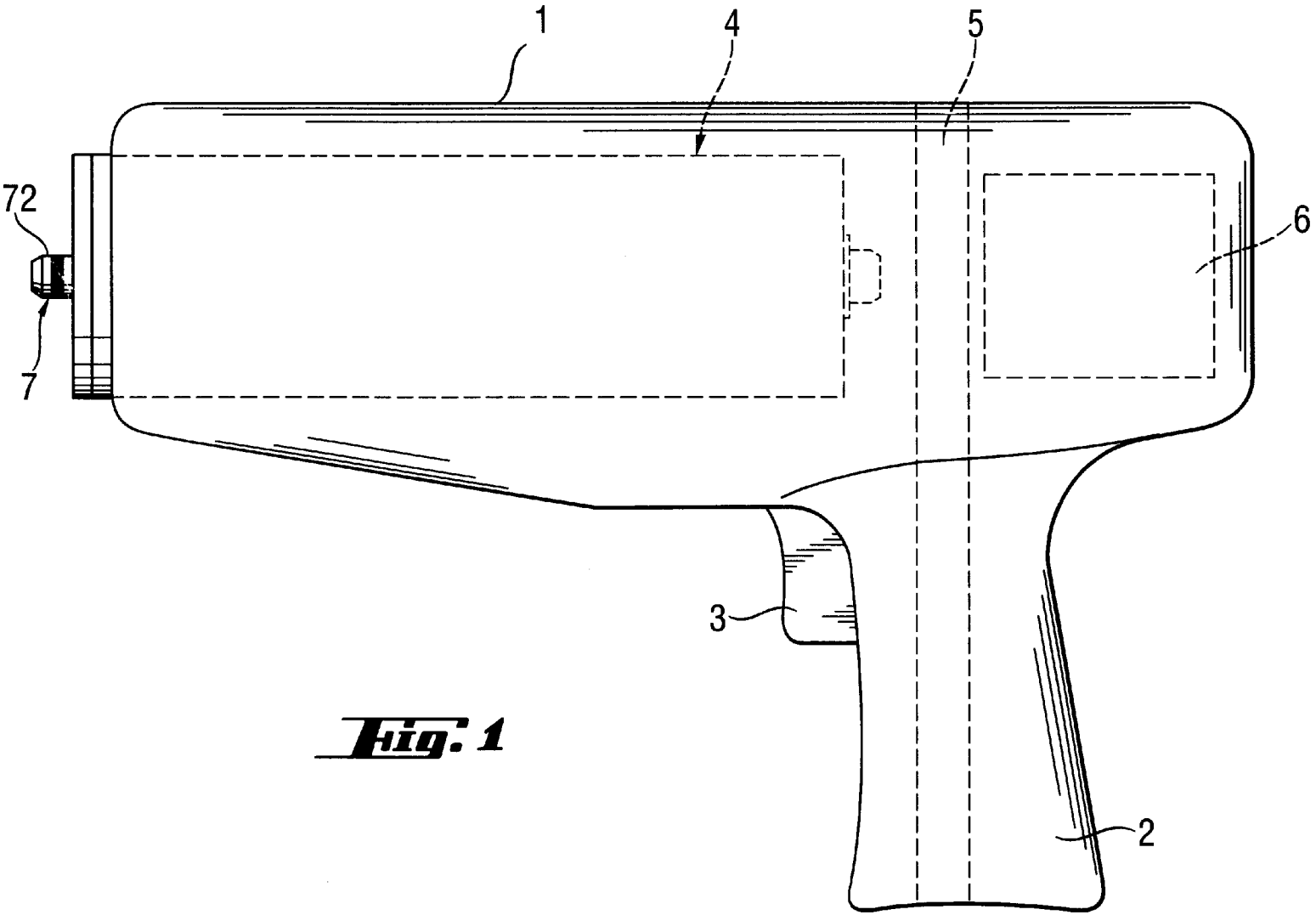
FIG. 1 shows a schematic side view of a setting tool according to the present invention.

In the description below, similar elements will be designated with the same reference numerals.

A setting tool according to the present invention, which is shown in FIG. 1, includes a housing 1, a handle 2, and an activation trigger 3. Inside the housing 1, there are located a tubular housing part 4, which forms a portion of the housing 1, a cartridge channel 5, and an ignition mechanism 6. A first guide region 72 of a drive piston 7 projects beyond the housing part 4 in a setting direction.

As shown in FIGS. 2 through 6, the tubular housing part 4 has in its end region facing in the setting direction, an inner thread 42 engageable with an outer thread of an end plate 43. The end plate 43 can be provided, e.g., with a drive piston brake (not shown) or be connected with such a brake. The end plate 43 has a central bore the diameter of which corresponds to the guide region 72 of the drive piston 7. A pin-shaped pressure element 40, which cooperates with the ignition mechanism 6 and is displaced in the end plate 43, projects beyond the end plate 43 in the setting direction. The drive piston 7, in addition to the first guide region 72, has also a seal region 71 and a second guide region 73 located between the first guide region 72 and the seal region 71. The diameter of the seal region 71 is greater than the diameter of the first guide region 72 and smaller than the diameter of the second guide region 73.

The drive piston 7 is located in a guide cylinder 8 displaceably arranged in the housing part 4. The drive piston 7 is axially displaceable relative to the end plate 43, the housing part 4 and the cylinder 8. The guide cylinder 8 has a central bore formed of several sections having different diameters. The first, in the setting direction, section has a diameter which substantially corresponds to the diameter of the second guide portion 73 of the drive piston 7. The diameter of a second section, which adjoins the first section, has a diameter corresponding substantially to the diameter of the seal region 71. A bore having a substantially reduced diameter adjoins the second section of the cylinder bore at a side of the second section opposite to the setting direction. The reduced diameter bore connects the second section of the cylinder bore with a cartridge chamber 81 provided in the free end of the drive piston 7 facing in a direction opposite to the setting direction.

Both the housing part 4 and the guide cylinder 8 have radially extending, substantially overlapping each other, through-opening 41, 83, respectively, which are formed, e.g., as longitudinal slots. A carrier member 84 and a lever-shaped resetting member 10 extend through the openings 41 and 83. The carrier member 84 is arranged sidewise of the guide cylinder 8 and is fixed with respect to the cylinder 8 with connection means (not shown in detail). The lever-shaped resetting member 10 is pivotally arranged on a free end of the carrier member 84 located outside of the housing part 4.

Between the resetting member 10 and a driving surface 74 of the drive piston 7, which faces in the setting direction, there is located, e.g., an impact-absorbing member (not shown) which, e.g., may be arranged on the resetting member 10 or on the carrier member 84. The impact-absorbing member can be formed, e.g., of an elastic material.

Figure 2:
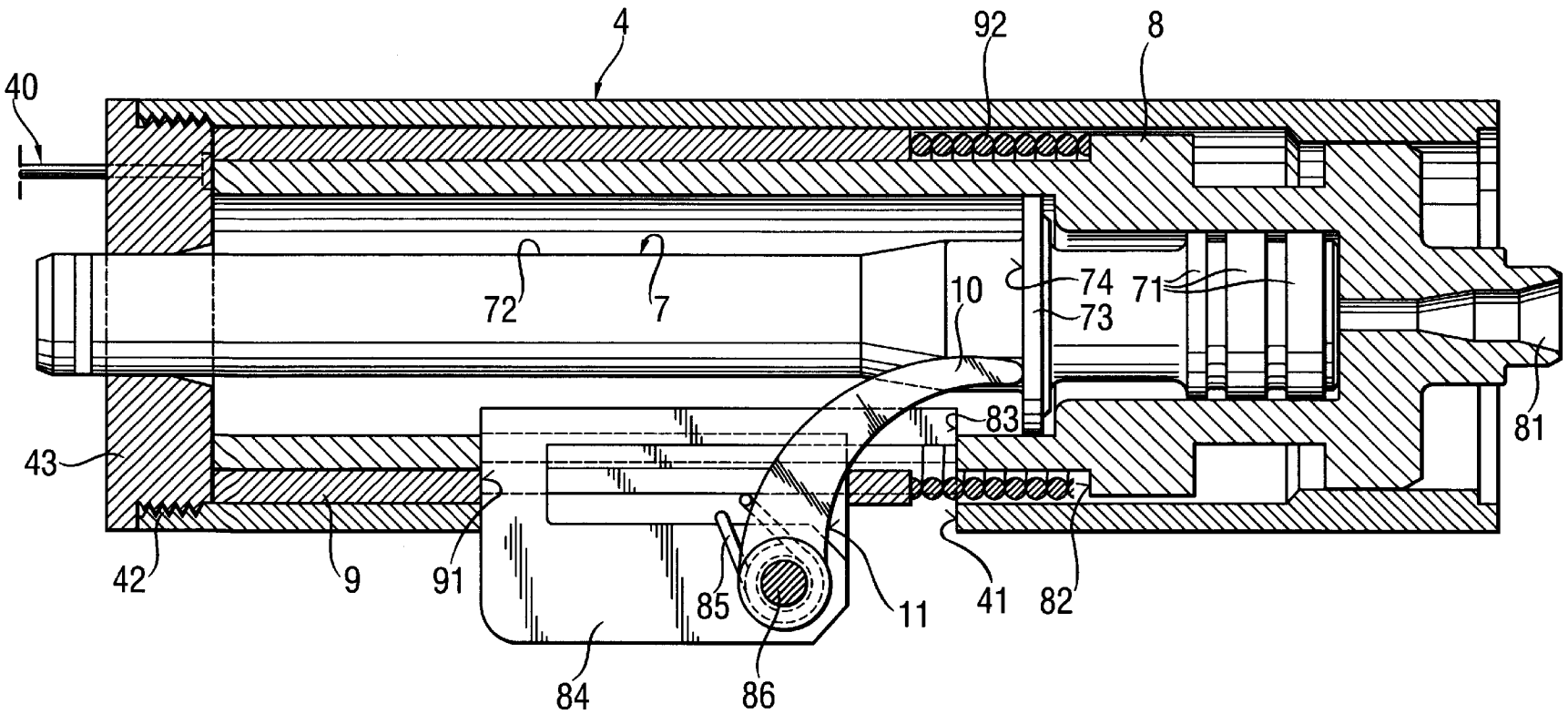
FIG. 2 shows a cross-sectional view at an increased scale of a portion of the housing of the setting tool shown in FIG. 1, with a lever-shaped resetting member in its initial position.
Figure 3:
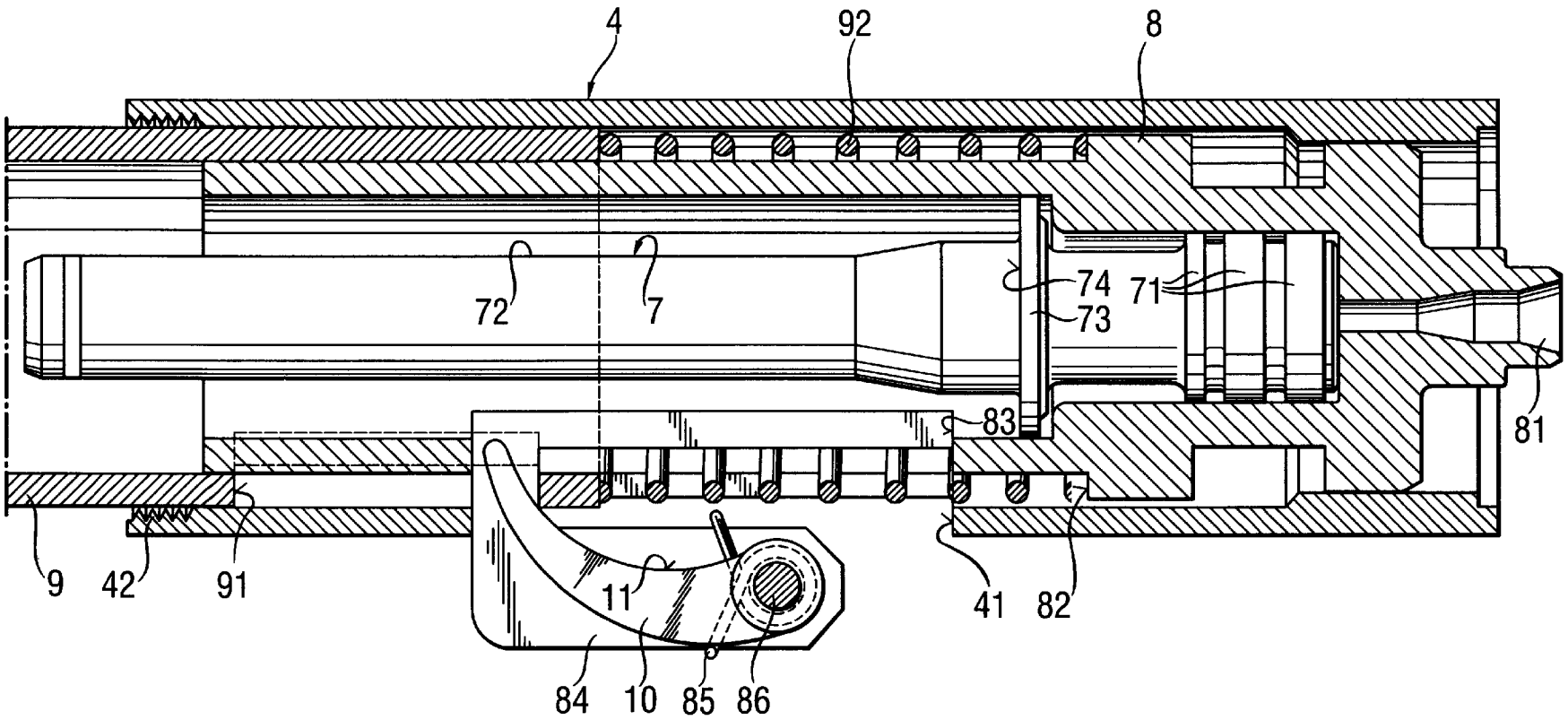
FIG. 3 shows a cross-sectional view of the housing portion shown in FIG. 1, with the resetting member in its release position and cooperating with a slide member.

In the embodiment of the setting tool shown in FIGS. 2–3, the resetting member 10 is connected with the carrier member 84 by a rotatable axle 86 which extends transverse to the setting direction. A spring member 85, which is supported against the carrier member 84 and the resetting member 10, is formed as a torsion spring. The spring member 85 surrounds the rotatable axle 86 and biases the resetting member 10 against the driving surface 74 of the drive piston 7. A sleeve-shaped slide member 9 is arranged between the housing part 4 and the guide cylinder 8. The sleeve-shaped slide member 9 is displaceable in the direction opposite to the setting direction against a biasing force of a spring 92 formed as a compression spring. The spring 92 surrounds the guide cylinder 8 and is supported against an end surface of the slide member 9, which faces in the direction opposite to the setting direction, and against a stop edge 82 of the guide cylinder 8 which faces in the setting direction. In FIG. 2, the spring 92 is shown in its compressed condition.

According to FIG. 2, the slide member 9 has a side opening 91 which is overlapped by the radial openings 41 and 83 of the housing part 4 and the guide cylinder 8. The carrier member 84 and the resetting member 10 extend through the side opening 91.

In FIG. 3, the housing part 4 is shown without the end plate 43 and without the pin-shaped pressure element 40. The compression spring 92 provides for the displacement of the slide member 9 in the setting direction so that it projects beyond the end of the housing part 4 facing in the setting direction. Upon displacement of the slide member 9 in the setting direction, a stop edge of the side opening 9 impacts a stop surface 11 of the resetting member 10, and the resetting member 10 pivots in a setting direction until it reaches the release position in which it does not project into the interior of the guide cylinder 8 or into a plane of the axial projection of the driving surface 74 of the drive piston 7.

The stop surface 11 is formed by a side of the resetting member 10 which is located adjacent to the stop edge of the slide member 9 facing in the setting direction. The biasing force applied by the compression spring 92 to the slide member 9 is greater than the force applied by the torsion spring 85 to the resetting member 10.

Figure 4:
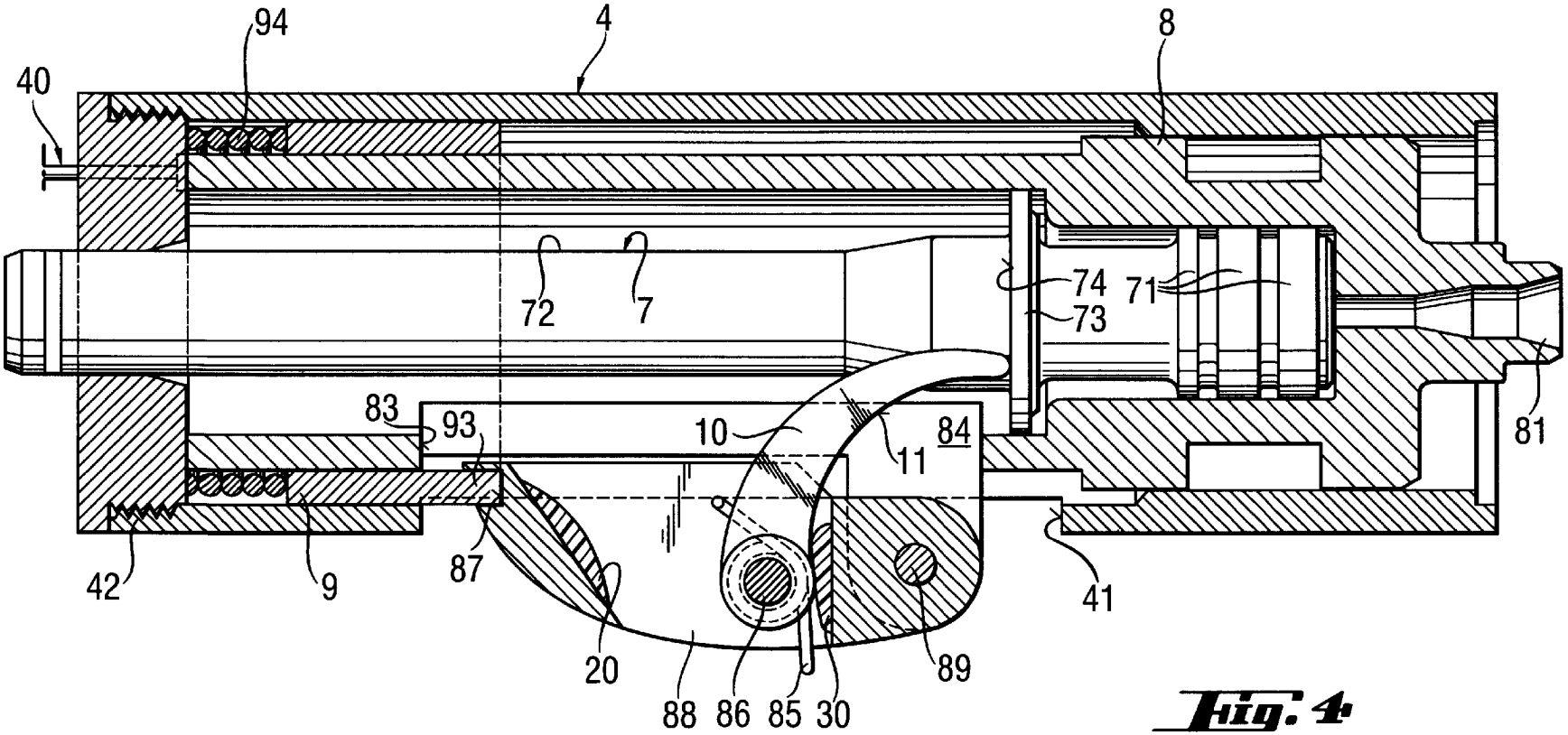
FIG. 4 shows a cross-sectional view at an increased scale of a portion of the housing of another embodiment of a setting tool according to the present invention, with a lever-shaped resetting member being mounted on a carrier arm which is located in its closed position.
Figure 5:
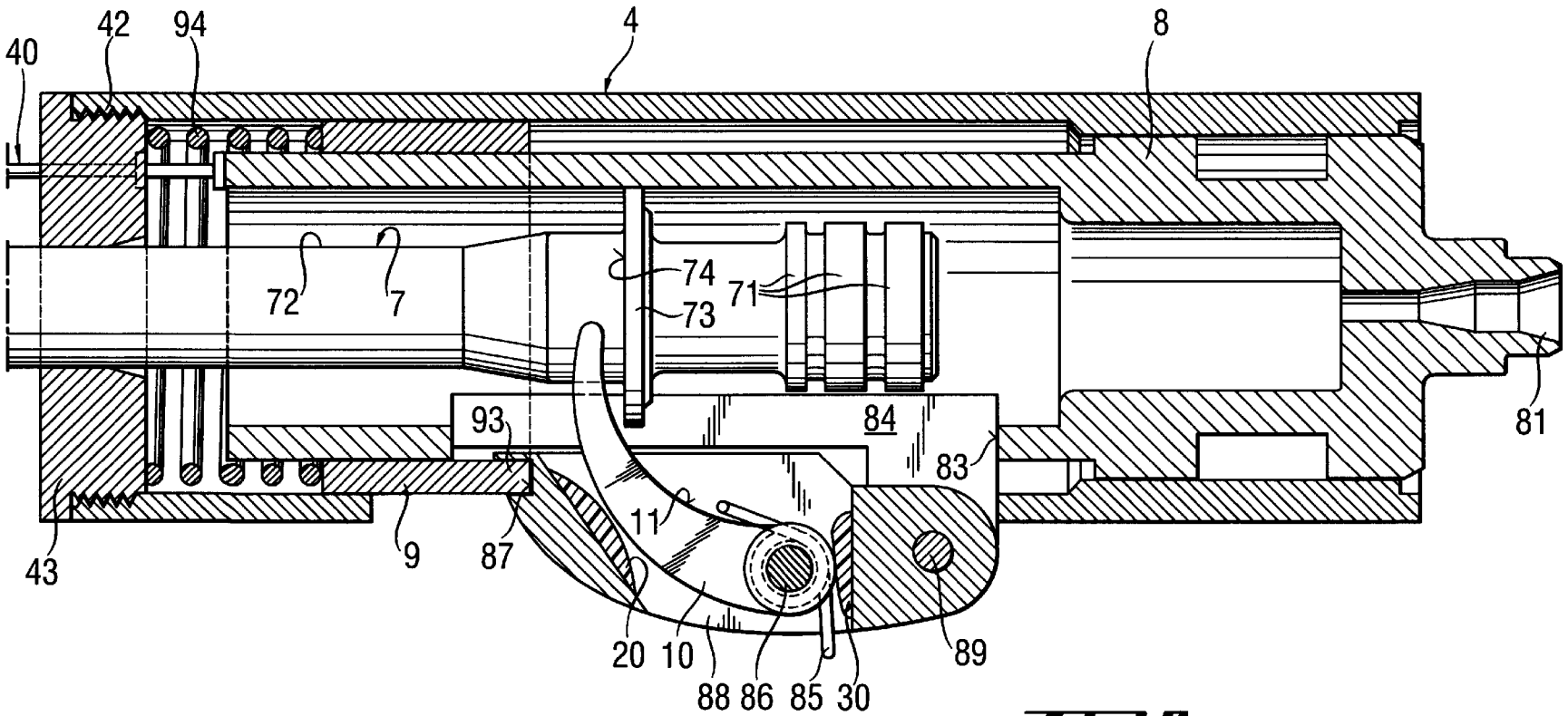
FIG. 5 shows a cross-sectional view of the housing portion shown in FIG. 4, with the resetting member in its operational position.
Figure 6:
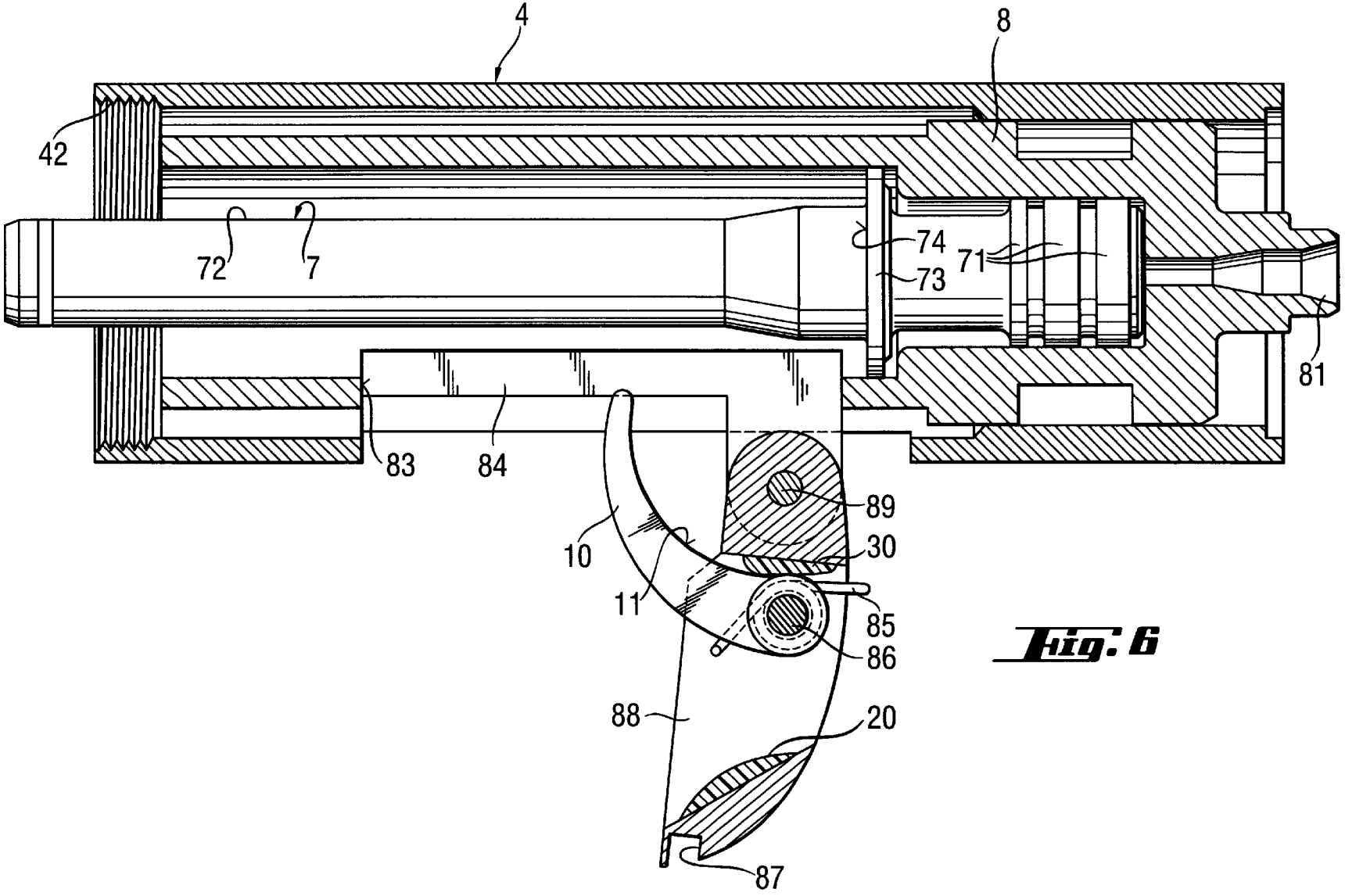
FIG. 6 shows a cross-sectional view of the housing portion shown in FIGS. 4–5, with the carrier arm in its open position.

In FIGS. 4–6, the resetting member 10 is connected with the carrier member 84 by a carrier arm 88. The resetting member 10 is supported for pivotal movement relative to the carrier member 84 by a rotatable shaft 89 extending transverse to the setting direction. The pivotal movement of the resetting member 10 takes place about a rotational axle 86 extending transverse to the setting direction.

As in the embodiment shown in FIGS. 2–3, the spring member 85, which is formed as a torsion spring surrounds the axle 86 and is supported against the resetting member 10 and the carrier member 84. The spring member 85 biases the resetting member 10 against the driving surface 74 of the drive piston 7 when the carrier arm 88 is in its closed position. This position of the resetting member 10 defines the initial position of the resetting member. The initial position of the resetting member 10 is shown in FIG. 4. The resetting member 10 is pivoted into its operational position by the drive piston 7. In the operational position of the resetting member 10, the drive piston 7 is located in its frontmost, in the setting direction, position. The pivotal movements of the resetting member 10 from the initial position and into the operational position are dampened by damping members 20, 30.

Between the housing part 4 and the guide cylinder 8, as in the embodiment of FIGS. 2–3, a sleeve-shaped slide member 9 is arranged. The slide member 84 is biased by tension spring 94, in direction opposite to the setting direction, toward the carrier arm 88. The carrier arm 88 has an indentation 87, which opens toward the setting direction. The indentation 87 is formed as a recess, into which a locking profile 93 of the slide member 9 projects when the carrier arm 88 is in its closed position.

FIG. 5 shows the resetting member in its operational position. The carrier arm 88 is in its closed position.

In FIG. 6, the side of the housing part 4 is not closed by an end plate, and there is no tension spring and a slide member between the housing part 4 and the guide cylinder 8. Because there is no slide member projecting into the indentation of the carrier arm 88, the latter can be pivoted relative to the carrier member 84 so that the resetting member would not project into the plan of the axial projection of the driving surface 74 of the drive piston 7.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed:

1. A setting tool for driving nail-shaped attachment elements into a hard structural component, comprising a housing (1); a guide cylinder (8) located in the housing (1); a drive piston (7) axially displaceable in the guide cylinder (8) and having a driving surface (74); a lever-shaped resetting member (10) pivotable in a plane extending parallel to a setting direction; an axle (86) for supporting the resetting member (10) for pivotal movement thereof; spring means (85) for biasing the resetting member (10) toward the driving surface (74) of the drive piston (7); and means for displacing the resetting member (10) in said setting direction out of a plane of axial projection of the driving surface (74) into a release position of the resetting member.

2. A setting tool according to claim 1, wherein the resetting member-supporting axle (86) is mounted on the guide cylinder (8).

3. A setting tool according to claim 2, further comprising a slide member (9) displaceable parallel to the setting direction and engaging the resetting member (10).

4. A setting tool according to the claim 3, further comprising spring means for displacing the slide member into the setting direction.

5. A setting tool according to claim 1, further comprising a carrier arm (88) for supporting the axle (86) of the resetting member (1) and displaceable relative to the guide cylinder (8).

6. A setting tool according to claim 5, wherein the carrier arm (88) is displaceable in a plane extending parallel to the setting direction.

7. A setting tool according to claim 5, further comprising at least one damping member (20, 30) for limiting the pivotal positions of the resetting member (10).

8. A setting tool according to claim 7, wherein the damping element is arranged on the carrier arm (88).

* * * * *